United States Patent [19]

Heaney

[11] 4,221,443

[45] Sep. 9, 1980

[54] FULLY EXPOSED SHELF STANDARD

[75] Inventor: James J. Heaney, Glendale, Calif.

[73] Assignee: Anthony's Manufacturing Company, Inc., San Fernando, Calif.

[21] Appl. No.: 910,380

[22] Filed: May 30, 1978

[51] Int. Cl.[2] ..... A47B 57/00; A47G 29/02

[52] U.S. Cl. ..... 312/306; 312/111; 312/140; 248/243

[58] Field of Search ..... 312/304, 306, 312, 340, 312/211, 214, 257 SK, 257 SM, 257 A, 140; 248/243, 201; 108/109, 114

[56] References Cited

U.S. PATENT DOCUMENTS

| | | | |
|---|---|---|---|
| 2,928,512 | 3/1960 | Slater et al. | 248/243 |
| 3,261,585 | 7/1966 | Constantini et al. | 248/243 |
| 3,512,654 | 5/1970 | Olsen et al. | 248/243 |
| 3,614,044 | 10/1971 | Bard | 248/243 |
| 3,731,956 | 5/1973 | Hanley | 312/111 |
| 3,936,024 | 2/1976 | Jung | 248/243 |
| 3,982,801 | 9/1976 | Heidorn et al. | 312/306 |
| 4,067,445 | 1/1978 | Derclaye | 248/243 |
| 4,090,753 | 5/1978 | Rock et al. | 312/140 |

FOREIGN PATENT DOCUMENTS

| | | | |
|---|---|---|---|
| 624707 | 11/1962 | Belgium | 248/243 |
| 1210528 | 2/1966 | Fed. Rep. of Germany | 108/109 |
| 652304 | 2/1963 | Italy | 248/243 |
| 1168332 | 10/1969 | United Kingdom | 248/243 |

*Primary Examiner*—Victor N. Sakran
*Attorney, Agent, or Firm*—Richard Morganstern

[57] ABSTRACT

A refrigerated display cabinet interior shelf system has one piece standards for shelf support. The standards are manually removeable from slotted brackets fixed to mullions in a cabinet structure. The standards have surfaces fully exposed to the cabinet interior. Each standard can maintain two shelf supporting clips on opposite sides at the same vertical dimension. The shelf system is manually disassembleable, and when assembled effectively eliminates protruding threaded fastener elements and multiple components in the shelf support system.

15 Claims, 9 Drawing Figures

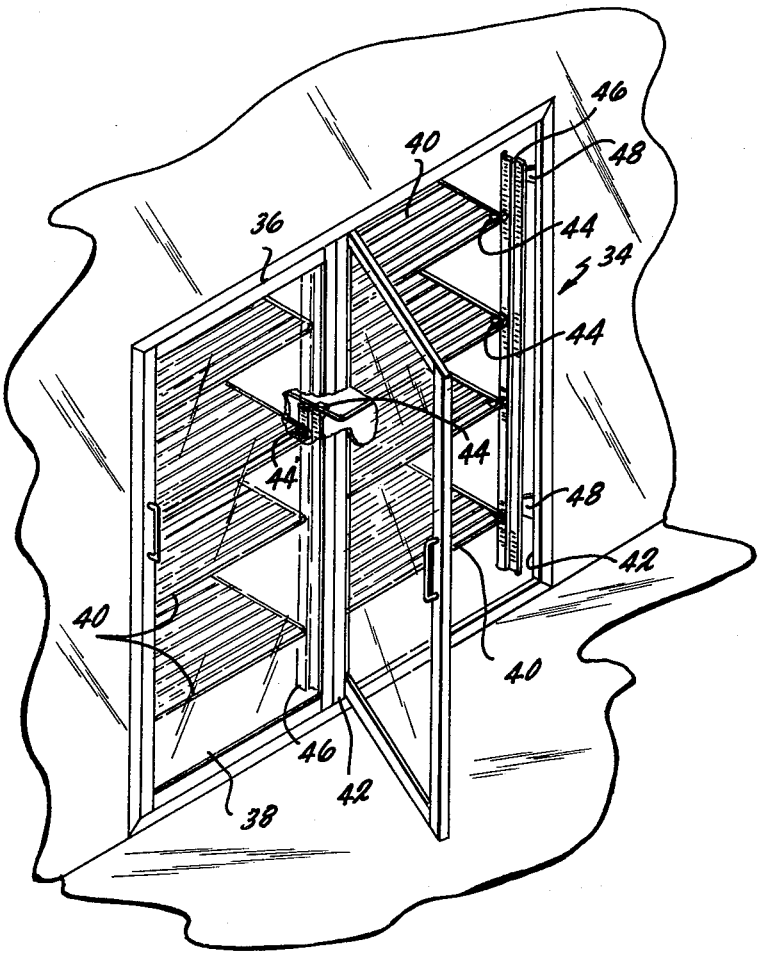
Fig. 5
Fig. 7
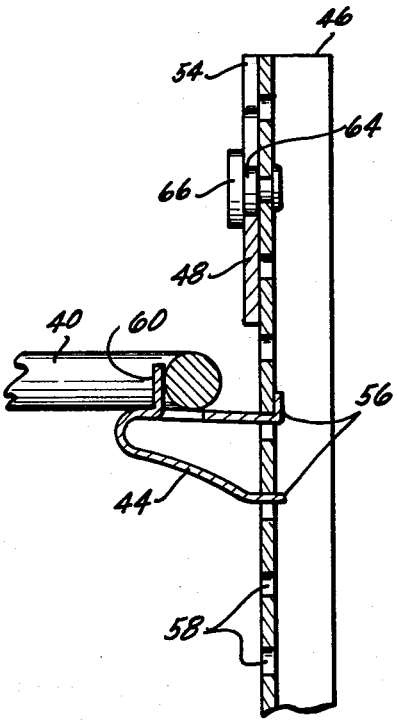
Fig. 8
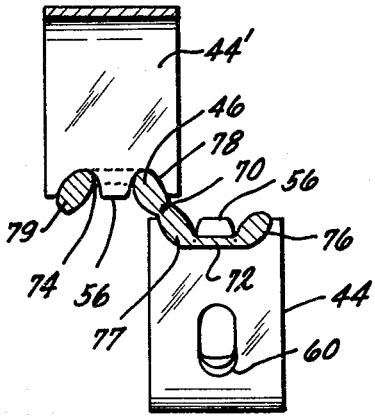

FULLY EXPOSED SHELF STANDARD

BACKGROUND OF THE INVENTION

1. Field of the Invention

The present invention relates to the art of storing and displaying perishable goods, and more particularly relates to shelf and standard arrangements for refrigerated display cabinets.

2. Description of the Prior Art

Modern self-service supermarket type retailing has required innovative shelving in order to display wares fully to discerning shoppers. Such self-service shelves serve not only to present the goods attractively, but also to provide storage space. To store more items efficiently without detracting from the attractiveness of the overall presentation is a goal presenting problems as times.

Such problems are particularly significant in shelving for storing perishables that must be refrigerated. Such shelving must be constructed wholly within the refrigerated enclosure to maintain a relatively air-tight enclosure. Yet, it is often desired to change the position of such shelves, either by altering the vertical spacing between shelves or removing shelves to accommodate varying sizes of food containers.

Other features are desired which determine ultimate design. In food displays, it is important, for example, that the shelves and interiors of refrigerated display cabinets be made of materials which are easily cleaned. Frequently, milk, sugared drinks and other perishables leak or escape from their containers and adhere to shelves, shelf standards or cabinet interiors. If left uncleaned, the odor becomes unpleasant and the scene is not appetizing. The shelves and cabinet interiors, therefore, should be easily reached for cleaning.

Indeed, the National Sanitation Foundation has established a requirement that shelf standards and shelves in refrigerated cabinets must be capable of manual removal, unassisted by implements or tools. Further, all standards and shelves must have all parts, when so disassembled, fully exposed for ready cleaning. "Fully exposed" as hereinafter used in this specification means that all surfaces are open to the outside, and are directly reached by a human hand without the aid of specially designed implements or tools.

Often it is desired to position standards inside the refrigerated cabinet. Such standards have recesses, holes or slots for receiving clips. Such holes are formed at regular intervals along the vertically placed standard so that the clips can be positioned at a selected one of a very large number of discrete vertical heights. Shelves are laid on two or four clips at the same height on two or four respective standards arranged within the cabinet interior.

In the past and at the present, the materials for such standards are relatively thin for reasons of economy and manufacture. Relatively thin elements of a standard can be made by extrusion, a relatively simple and low cost method of manufacture. Thin elements, however, may lack necessary strength for supporting a large number of shelves and accompanying stored articles. If relatively thin metal is to be used for the standard, some arrangement must be made to strengthen or reinforce the standard.

Frequently standards are placed in the center of the lateral dimensions of the cabinet interior to section off the space within the display cabinet interior into different portions or rows. Such a center-positioned standard should have the capability of supporting slips on either of its lateral sides at the same height.

Summarizing the requirements for shelf systems and standards for shelf systems within refrigerated display cabinet interiors, it is seen that the shelves must be easily removed from the cabinet, and positioned within the cabinet at varying selected heights according to the foods and containers for foods that are to be displayed. The standards supporting the shelves should be capable of supporting shelves on both sides of the standard, and each standard should be easily removable from the shelf system and cabinet interior without the use of implements or tools. The entire shelf and standard arrangement should be readily cleaned by hand, without the necessity for special tools or implements.

The prior art has sought to meet these requirements more or less by a system having two relatively thin extruded metal strips, each having holes punched therethrough. The metal strips are placed back-to-back, usually about a separator or spacing bar providing strength. The entire assembly is joined by some fastening means joining not only the component parts together, but also the standard assembly to the cabinet structure.

Each extruded metal strip in this multiple component assembly normally has a slightly bent vertical edge to create a slight space or volume for receiving stud portions of shelf-supporting clips. The strength bar then operates further to separate the space behind the oppositely aligned extruded metal strips, in order to prevent the stud portions of shelf-supporting clips from interfering with each other when they are positioned at relatively comparable heights on opposite sides of the standard.

Such an arrangement presents several areas of difficulty. In the first place, the assembly may contain seven component parts, including several two-part fasteners. In order to solve the problem of manual disassembly, the fasteners usually include a wing-tip nut or some other threaded nut arrangement which is sufficiently large so as to be turned by hand. Such a wing-tip nut assembly invariably presents an extension or protrusion into the interior of the cabinet, and may act as a snag for patrons' arms and hands. The sharp flanks of the nut are capable of puncturing or breaking containers, such as paper milk containers or glass bottles. Further, corrosion of the nut assembly may prevent simple manual removal of the nut.

The steel strip backside space for receiving the shelf-supporting clip studs forms a trap for perishable food components, such as liquids or small food solids, such as powder. It is impractical to clean the standard without disassembling the standard into its component parts. In addition the spacer bar, in order to provide the necessary strength for supporting shelves on both sides of the standards, necessarily must have some volume which detracts from the usable space within the cabinet interior.

One attempt by the prior art to solve these problems involves providing a deeply recessed U-channel having clip receiving holes punched through oppositely faced sides of the U-structure. Since the shelf-supporting clips often have side studs for stabilizing the clip on the standard, each individual, oppositely faced side portion itself has a U-shaped form. The resulting corrugation in the channel structure further serves the purpose of providing strength in the individual faces themselves.

These two oppositely faced U-shaped forms are connected by an integral connector to form the deeply recessed U-channel. In this embodiment, the U-channel is mounted on brackets extended from mullions, the brackets being welded to the standard. The effect of this welded connection is to create a section or portion of the U-channel which is virtually enclosed except for the clip holes and the very narrow opening at the top of the U-shape.

There are several problems associated with this embodiment, including the requirement to unscrew or otherwise dislodge the brackets from the mullions in order to remove the standard from the refrigerated cabinet. There is a wasted volume or space defined by the interior of the U-channel, which acts as a trap for food seeping or falling through the clip retaining holes along the oppositely disposed faces of the channel. The interior of this channel is cleaned only with the help of specially designed cleaning implements. Indeed, in the closed space within the channel between the welded brackets, it is difficult to remove perishable liquid or solid deposits even with special brushes.

A simply constructed and readily assembled shelf and standard arrangement for cabinet interiors which will meet all of the safety and sanitary requirements considered essential for enclosed cabinet display arrangements is desired. A simple one-piece standard capable of having shelf-supporting clips mounted on opposite sides at the same height is particularly desired. It is sought, further, that the one-piece standard will have all surfaces fully exposed for ready cleaning. The desired standard, further, should not have unreasonable extensions for snagging the displayed or stored goods, and should be easily removed from the cabinet interior. In addition, the standard should have sufficient strength to support along its vertical height a number of shelves with goods placed thereon.

SUMMARY OF THE INVENTION

In brief, in accordance with one aspect of the invention, a shelf system for the interior of a refrigerated display cabinet is described. The shelf system comprises a refrigerated display cabinet having a monolithic standard article capable of supporting shelves on both sides, and having all of the surfaces of the standard article fully exposed. The shelf system includes brackets mounted to mullions of the cabinet, wherein the brackets have upwardly extending slots for receiving complimentally shaped knobs therein. The knobs comprise a flanged stud having a neck shaped to slide in the slots, and are fixed to the standard article. The standard can then be removably slid out of the brackets.

In accordance with another aspect of the invention, a monolithic standard article having all of its sides fully exposed, has a longitudinal extension in a first direction, a predetermined lateral width in a second direction and a predetermined extension in a third direction, where the first, second and third directions are substantially mutually orthogonal. By the term "extension in a third direction" is meant a maximum displacement along the third mutually orthogonal direction which the shape of the standard article has.

In this embodiment, the standard article has a first face and a second face both extending in the longitudinal direction and having a plurality of longitudinally spaced recesses therein for receiving removable shelf support clips. The first and second faces are substantially parallel to each other, facing outwardly and in opposite directions from each other and are laterally displaced from each other in the second direction so that there is no overlap in the second, lateral direction. The first and second faces are spaced from each other by the extension in the third direction.

In yet another alternative embodiment, the monolithic standard article is described having its surfaces fully exposed. First and second open channels extending substantially in a longitudinal direction have a trough or mid-section and side walls. The channels are joined in the monolith by a common side wall of each. The channel opening of the first channel opens or faces in a direction opposite to the opening or facing of the opening of the second channel.

In yet another alternative embodiment, a monolithic standard article having its surfaces fully exposed and capable of supporting shelves on both sides extends in a longitudinal or first direction. The standard article has a support bar portion generally aligned in a second direction orthogonal to the longitudinal direction. A second support bar portion is generally aligned with the first support bar portion in the second direction, and is positioned spaced from and parallel to the first support bar portion. A third, joining rib portion is generally aligned in a direction oblique from the second direction, forming an obtuse angle with the second direction of both the first and second support bar portions.

Other novel features which are believed to be characteristic of the invention, both as to organization and method of operation, together with further objects and advantages thereof, will be better understood from the following description considered in connection with the accompanying drawings in which several preferred embodiments of the invention are illustrated by way of example. It is to be understood, however, that the drawings are for the purpose of illustration and description only, and are not intended as a definition of the limits of the invention.

BRIEF DESCRIPTION OF THE DRAWINGS

FIG. 5 is a perspective view of the preferred embodiment showing the shelving system of the present invention, having portions cut away for clarity in presentation;

FIG. 7 is a side elevational cross-section view of an alternative embodiment of the invention;

FIG. 8 is a plan partial cross-section of the embodiment of FIG. 7; and

DESCRIPTION OF THE PREFERRED EMBODIMENT

Figure 1:
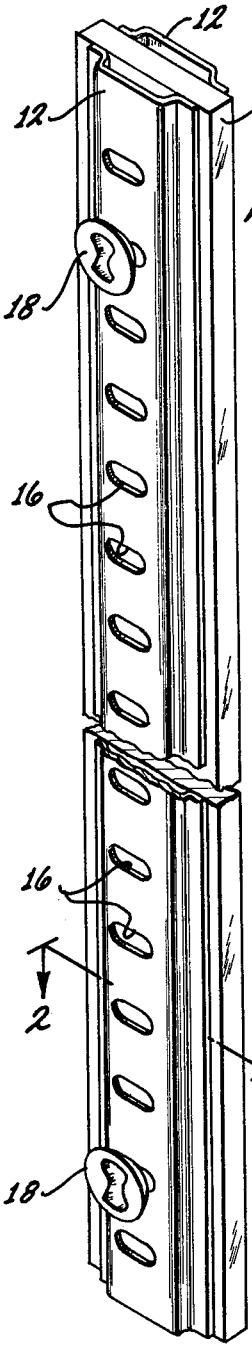
FIG. 1 PRIOR ART
FIG. 1 is a perspective view of a prior art standard having multiple elements.
Figure 2:
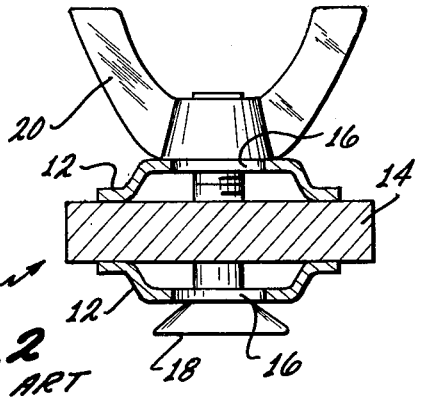
FIG. 2 PRIOR ART
FIG. 2 is a cross-section, top view of the prior art seen in the direction of the arrows along line 2—2 of FIG. 1.

A typical standard of the prior art is illustrated in perspective in FIG. 1, and in a cross-section top view in FIG. 2. In FIG. 1 a standard 10 is comprised of two relatively thin stainless steel strips 12 having bent offsets at their edges to give the center portion or section a raised effect. An aluminum bar 14 spaces and separates the oppositely disposed strips 12 to provide structural strength.

Each stainless steel strip 12 has a row of holes 16 vertically arranged along the center section or raised portion. These holes 16 conveniently receive a shelf-supporting clip, which will be explained in greater detail below in connection with the present invention and in connection with FIGS. 6 through 8. The bar 14 serves also to prevent interference between shelf-supporting clips attached through holes in strips 12 opposite each other on the bar 14.

FIG. 2 is a cross-sectional view of the standard 10 taken along line 2—2 of FIG. 1, showing the structural bar 14 spacing the strips 12. A threaded fastener 18 is inserted through a hole 16 in one strip 12, through a specially prepared hole in the structural bar 14 and through a hole 16 in the oppositely disposed strip 12. A wing tip nut 20 is threaded onto the exposed end of the fastener 18 to secure the oppositely disposed strips 12 and structure bar 14 together. Several such fasteners 18 and wing tips 20 are arranged along a single standard 10, as is shown in FIG. 1, to insure a united standard structure.

It can be appreciated that the standard 10 of FIGS. 1 and 2 may be capable of providing the structural strength necessary for supporting a plurality of loaded shelves in a cabinet provided that the bar 14 is large enough. The wing tip fastener system can be used to fasten the standard 10 to a bracket which ultimately extends from a mullion inside a refrigerated cabinet. The flanges of the wing tip nut 20 extend into the interior of the cabinet, however, and provide an undesireable snag for patron's hands and which may puncture or break food items. Other disadvantages of the arrangement are evident in the multiple components which must be assembled together, many of the components being made of different materials and by different manufacturing processes.

The spacing between the raised sections of the steel strips 12 and the separator bar 14, and the numerous clip receiving holes 16 combine to provide a trap into which perishable liquids and small food stuffs such as powders can seep or fall.

Figure 3:
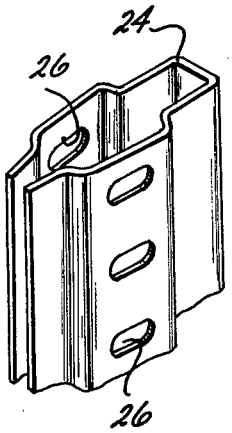
FIG. 3 PRIOR ART
FIG. 3 is a perspective view of a cutaway of a second concept of the prior art showing the interior of a U-shaped standard.
Figure 4:
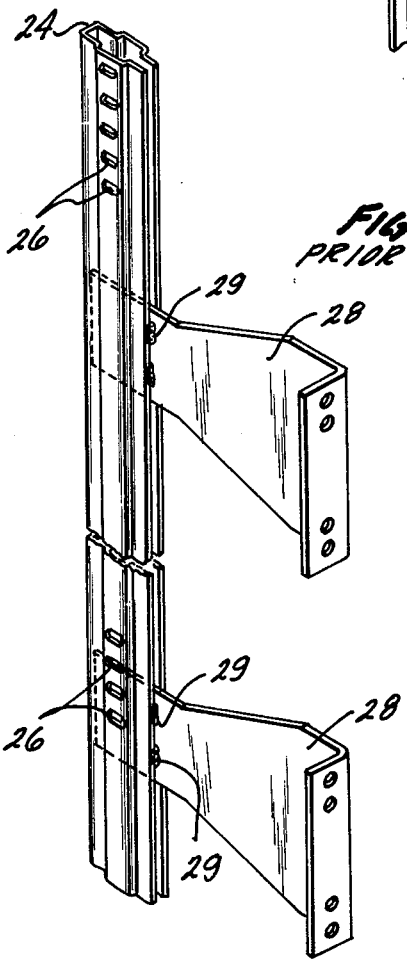
FIG. 4 PRIOR ART
FIG. 4 is a perspective of the prior art U-shaped standard shown in FIG. 3 in partially cutaway full length.

FIGS. 3 and 4 show an alternative embodiment of the prior art, which had as an aim the elimination of several of the problems of the embodiment of FIGS. 1 and 2. Particularly, in FIG. 3 a U-shaped channel 24 provides a unitary, one-piece standard having holes 26 on opposite sides of the flange channel for receiving shelf-supporting clips. The U-shape, having opposed faces or sides formed in a corrugated or slight U-shape, provides notably improved strength over the elongated, vertical length of the standard so as to eliminate the need for a structure bar, such as the bar 14 of FIGS. 1 and 2.

FIG. 4 shows the extended length of the U-shaped channel 24, having a central portion of the length cut away for brevity in illustration. The U-shaped interior is especially adapted for receiving the ends of brackets 28, which are welded as at welds 29 to the channel 24. The brackets 28 can be fastened to the mullions of the cabinet interior.

The prior art embodiment as illustrated in FIGS. 3 and 4 solves many of the problems of the embodiment of FIGS. 1 and 2, but clearly provides a unitray, permanently fixed standard for the cabinet. Cleaning the interior of the U-shaped channel 24 is an obvious problem, solved only by specially shaped implements or tools. The holes 26 and permanently closed interior of the channel 24 make for the perishable food trap found in the embodiment of FIGS. 1 and 2.

The brackets 28 extend into the interior of the U-shaped channel 24 and, when welded, form a section of the channel whose openings are only the holes 26 and the very narrow opening of the "U". Cleaning of this section of the channel is indeed difficult.

FIG. 5 illustrates the preferred embodiment of the present invention in a perspective view. A refrigerated cabinet 34 is shown having a frame 36 for transparent doors 38. Shelves 40 are shown positioned at various selected heights in the cabinet interior. The shelves 40 are of the spaced bar variety, having a plurality of spaced parallel bars arranged within a stronger peripheral frame. These shelves 40 are often preferred in self-service stores such as supermarkets, since they are lighter, more easily maneuvered and allow vertical visibility to shoppers viewing the items both from below and from above.

The cabinet 34 has mullions 42 having the capability of supporting standards 46 for supporting the shelves 40. The shelves 40 rest on shelf-supporting clips 44 which are selectively positioned along the vertical dimension of standards 46. The standards are mounted to the mullions 42 on brackets 48.

Figures 6, 9:
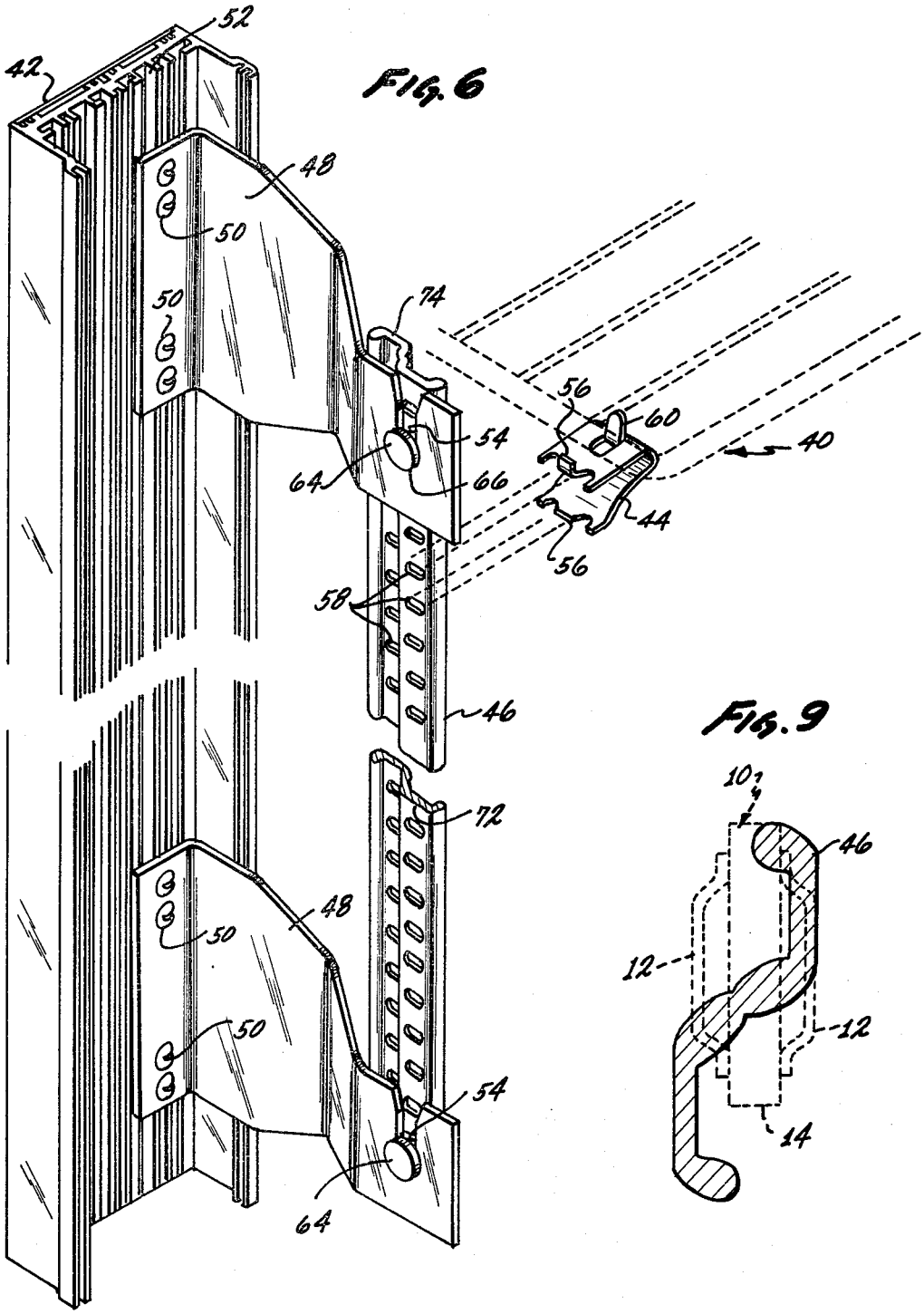
FIG. 6 is a perspective view of a mullion portion of the invention shown in FIG. 5, showing shelves in phantom lines.
FIG. 9 is a schematic superposition of the cross-sections of the embodiment of FIG. 7 and of the prior art seen in FIG. 1.

FIG. 6 illustrates in perspective a mullion 42 supporting brackets 48 fixed thereto. In particular, the brackets 48 can be fastened by threaded fasteners 50 into threaded fastener receiving slots 52 in the interior side of the mullion 42. The brackets 48 extend perpendicularly from the mullion 42 into the cabinet interior as in conventional brackets such as that illustrated in FIG. 4 for the prior art. Unlike brackets of the prior art, each bracket 48 has a slot 54 opening to the vertical top.

Shelf-supporting clips 44 are shown having two studs 56 which fit within holes 58 of the standard 46. A parallel, spaced bar type shelf 40, shown in phantom in FIG. 6, rests on top of the clip 44, having a peripheral bar lodged between the standard 46 and a punch-out 60 punched out and extending integrally from the clip blank.

FIG. 7 shows a side elevation of FIG. 6 in partial cross-section having the shelf-supporting clip 44 engaging the standard 46. The spaced, parallel bar shelf 40 has been arranged having one of its peripheral bars hooked or lodged between the clip punch-out 60 and the standard 46. As seen partially in FIG. 6 but in greater detail in FIG. 7, a knob 64 having a flanged end 66 is fixed to the standard 46 through one of the openings 58. The shaft of the knob 64 is bradded on the interior side, and is designed to slide freely but with close tolerance within the slot 54. The flanged end 66 should have a diameter substantially larger than the width of the slot 54, to prevent the knob 64, and consequently the standard 46 from separating from the bracket 48.

It is expected that for the usual refrigerated cabinet, each mullion should have two such brackets 48 holding a standard. Extraordinarily tall cabinets and cabinets having irregular vertical designs for the standard may require additional brackets. There should be a knob 64 on the standard for each mullion bracket to which the standard is positioned.

Turning now to FIG. 8 of the drawings, but with continuing reference to FIGS. 6 and 7, the standard 46 is seen in cross-section. Two shelf sustaining clips 44, 44' are shown positioned at substantially the same or comparable vertical height, but on opposite sides of the standard 46. While on opposite sides, the clip 44 is not directly opposite the clip 44' on the standard 46, but rather is offset. The structure allows for freedom from interference between the clips 44, 44' will be described in greater detail below.

The novel standard 46 is designed to be symmetrical about a center axis 70, having two symmetrical parts 72, 74. The standard 46 is made from a single, monolithic piece of metal. The standard may be formed by an extrusion process, by roll forming, or by other processes such as casting and the like. The standard forms an elongated monolithic strip having a center line coincident with the center 70.

Each of the parts 72, 74 is flared to form what might be considered in cross-section a general U-shape. Such a U-shape channel structure provides greater vertical strength against bending. Each part 72, 74 defines a substantially flat mid-section between the flaring outer sections. Outer sections 76 and 77 flare from the mid-section of part 72, while outer sections 78 and 79 flare from the midsection of part 74.

Holes 58 are formed in the mid-sections of parts 72, 74 for receiving the shelf-supporting clips 44. By making the standard symmetrical about the center axis 70, the flared edges force the mid-sections to be offset from a median line between them, on lines generally parallel to each other. Thus oppositely facing clips, such as clips 44 and 44' in FIG. 8, can easily be inserted on the standard 46 at the same vertical elevation without mechanical interference between the two. There is no need for an additional separator bar or an additional strength bar.

It can be appreciated that the holes 58 formed in the mid-sections of the parts 72, 74 can, instead, be recesses. It is only required that some indentation be provided that can effectively receive in a removeable fashion the fastening portions of the shelf retaining clips. Other methods of fastening the clips to the standard may also be arranged on the standard itself.

The standards 46 are then placed at strategic corner edges within the cabinet 34, reference now being had momentarily to FIG. 5 of the drawings. The standards 46 should be attached to brackets 48 extending from mullions 42 in the center of the refrigerated cabinet, as well as from mullions in the corners of the cabinet 34. The standard attached to the center mullion 42 will have oppositely placed shelf-retaining clips, such as clips 44 and 44' to support shelves in both portions of the cabinet 34. Because of the offset and perfectly symmetrical construction of the standard 46, the clips 44, 44' can be positioned at precisely the same vertical elevation, if having the same level of shelves for both the right and the left portions of the cabinet 34 is desired. Of course, the clips can be positioned at any vertical elevation desired and in any portion within the cabinet 34, provided that that portion of the cabinet 34 has standards 46 arranged along a plurality of corner edges defining the space where the shelf will be placed. Those skilled in the art can appreciate that less or more than four standards can be used for supporting shelves.

FIG. 9 illustrates one of the many advantages to be obtained by using the standard of the present invention. As seen in FIG. 9, the cross-section of the FIG. 1 prior art standard 10, shown in phantom having three of the seven component parts, defines a certain area. The single, monolithic standard 46 of the present invention defines a unified cross-sectional area which is shown superposed on the standard 10. The reduction in cross-section area achieved by the concept of the standard embodiment of the present invention is substantial.

By using aluminum and extruding it into the form of the standard 46, the standard 46 can be made substantially lighter than the multiple component, larger standard 10 of the prior art. Further, where the strips 12 are made of stainless steel and the supporting separator bar 14 is made of aluminum, the standard 46 is found to have substantially less weight per inch than the standard of the prior art embodiment. Other advantages will become apparent to those skilled in the art after studying the concepts of the present invention.

The standard of the present embodiments of the invention defines what might be termed a double standard inasmuch as shelf-supporting clips can be positioned on both sides of the standard without interference between the clips. The standard of the present invention notably has substantially or relatively flat surfaces for ready cleaning and accessibility. This double, flat standard comprises a substantially simple, monolithic element comprising essentially one part which is capable, with the sole addition of relatively simple bracket studs, of performing the same function as the multiple component and complicated arrangements of the prior art.

Another advantage in the present invention lies in the elimination of the need for a separator plate between opposed clip engaging strips. The reduction in volume occupied by the new standard indicates that additional volume is now available for storing and displaying shelved items. The elimination of interiorly protruding snags, such as the wing tip nut 20 not only provides more space but also facilitates removal of items by customers and patrons, while reducing the risk of punctured containers.

The fully exposed, open construction of the standard 46 of the present invention enables ready and immediate cleaning of the standards should any perishable food item spill or otherwise lodge onto the standard. The ease of removing the standard 46 from the brackets 48 and slot 54 arrangement of the present invention further facilitates cleaning by allowing the store supervisor to reach into spaces behind the standard when the standard is removed.

The foregoing detailed description is illustrative of several embodiments of the invention. It is to be understood, however, that additional embodiments can be perceived by those skilled in the art. The embodiments described herein together with those additional embodiments are considered to be within the scope of the present invention.

What is claimed is:

1. In a refrigerated display cabinet, a shelf support system for supporting shelves in the interior of a refrigerated cabinet, comprising:

(a) a monolithic standard for supporting shelves on both sides thereof, said standard having all its surfaces fully exposed and longitudinally extending in a first direction, and having a predetermined lateral width in a second direction and a predetermined extension in a third direction, said first, second and third directions being substantially mutually orthogonal, said standard having a first part and a second part, each said part extending along said first direction and having at least one face having recesses extending inwardly therefrom, said at least one face of said first part and said at least one face of said second part facing outwardly and in opposite directions from each other and being laterally displaced from each other in the second direction, and being spaced from each other by substantially the predetermined extension in the third direction;

(b) means adapted to fit removably into said recesses in said surfaces, for supporting shelves; and (c) standard support means attached to said cabinet interior, for supporting said monolithic standard within said cabinet.

2. The shelf support system of claim 1 wherein said first part and said second part comprise open channels having a trough portion defined by said at least one face having recesses extending inwardly therefrom, and side walls, wherein said first part is joined to said second part in the monolith by a common side wall of each part.

3. The shelf support system of claim 2 wherein the trough portion of said first part is laterally displaced in the second direction from the trough portion of said second part so that there is no lateral overlap in the second direction of the respective trough portions.

4. The shelf support system of claim 1 wherein said monolithic standard includes a knob attached to said standard.

5. The shelf support system of claim 4 wherein said standard support means comprises at least two brackets, and further comprises an upwardly opening slot in each said bracket, and said knob comprises a flanged stud having a neck shaped to slide in one of said slots.

6. An article comprising a monlithic standard for supporting shelves on both sides thereof, said standard having all its surfaces fully exposed, said standard longitudinally extending in a first direction and having a predetermined lateral width in a second direction and a predetermined extension in a third direction, said first, second and third directions being substantially mutually orthogonal, said standard having a first support face and a second support face, each face longitudinally extended in the first direction, each face being fully exposed and having a plurality of longitudinally spaced recesses therein for receiving removable shelf support clips, wherein said first and said second faces are substantially parallel to each other, and face outwardly in opposite directions from each other, and are laterally displaced from each other in the second direction, and are spaced from each other by substantially the predetermined extension in the third direction.

7. The monolithic standard article of claim 6 wherein said first face has no overlap with said second face in the lateral, second direction.

8. The article of claim 6 wherein said monolithic standard is comprised of two longitudinally extending channel portions joined in the monolith at an outside edge of each respective channel.

9. The monolithic standard article of claim 6 wherein said recesses are slots extending through the monolith.

10. The article of claim 6 wherein the monolithic standard comprises substantially a formed sheet.

11. An article comprising a monolithic standard for supporting shelves on both sides thereof, said standard having all of its surfaces fully exposed, said standard extending in a longitudinal direction and comprising a first channel and a second channel, each channel having a trough portion and side walls, and each channel extending in the longitudinal direction, said first channel and said second channel having faces opening outwardly and in opposite directions from each other, said standard having a plurality of longitudinally spaced recesses extending inwardly from each of said faces for receiving removable shelf support clips, said first channel and said second channel being joined in the monolith by a common side wall.

12. The monolithic standard article of claim 11 wherein said recesses are slots extending through the trough portion.

13. The monolithic standard article of claim 11 wherein said trough portion comprises a substantially straight mid-section, and wherein the trough of said first open channel and the trough of said second open channel are in substantially parallel planes relative to each other.

14. The monolithic standard article of claim 11 further comprising support means for supporting said article to a refrigerated display cabinet interior.

15. The monolithic standard article of claim 14 wherein said support means includes a knob fixed to said standard article and adapted to slide in upwardly opening slots formed in brackets fixed to mullions of said refrigerated display cabinet interior.

* * * * *